US007816645B2

(12) United States Patent
Kelly et al.

(10) Patent No.: US 7,816,645 B2
(45) Date of Patent: Oct. 19, 2010

(54) RADIAL ARRAYS OF NANO-ELECTROSPRAY IONIZATION EMITTERS AND METHODS OF FORMING ELECTROSPRAYS

(75) Inventors: Ryan T. Kelly, West Richland, WA (US); Keqi Tang, Richland, WA (US); Richard D. Smith, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 225 days.

(21) Appl. No.: 12/046,207

(22) Filed: Mar. 11, 2008

(65) Prior Publication Data

US 2009/0230296 A1 Sep. 17, 2009

(51) Int. Cl.
*H01J 49/10* (2006.01)

(52) U.S. Cl. ..... 250/288; 250/281; 250/282; 250/423 R; 250/424; 250/425

(58) Field of Classification Search ..... 250/281, 250/282, 285, 288, 423 R, 424, 425
See application file for complete search history.

(56) References Cited

U.S. PATENT DOCUMENTS

| | | | | |
|---|---|---|---|---|
| 6,066,848 | A * | 5/2000 | Kassel et al. | 250/288 |
| 6,525,313 | B1 * | 2/2003 | Park | 250/281 |
| 6,803,565 | B2 * | 10/2004 | Smith et al. | 250/288 |
| 6,831,274 | B2 * | 12/2004 | Smith et al. | 250/288 |
| 2002/0000516 | A1 | 1/2002 | Schultz et al. | |
| 2002/0000517 | A1 * | 1/2002 | Corso et al. | 250/288 |
| 2002/0003209 | A1 * | 1/2002 | Wood et al. | 250/282 |
| 2002/0043624 | A1 | 4/2002 | Hindsgual et al. | |
| 2002/0121598 | A1 * | 9/2002 | Park | 250/288 |
| 2002/0185595 | A1 * | 12/2002 | Smith et al. | 250/288 |
| 2003/0106996 | A1 | 6/2003 | Covey et al. | |
| 2003/0111599 | A1 * | 6/2003 | Staats | 250/288 |
| 2003/0160166 | A1 * | 8/2003 | Glish et al. | 250/288 |
| 2003/0168591 | A1 * | 9/2003 | Smith et al. | 250/288 |
| 2004/0155182 | A1 * | 8/2004 | Moon et al. | 250/288 |
| 2005/0109948 | A1 * | 5/2005 | Park et al. | 250/425 |
| 2006/0214099 | A1 * | 9/2006 | Oleschuk et al. | 250/281 |
| 2008/0314129 | A1 * | 12/2008 | Schultz et al. | 73/61.55 |

OTHER PUBLICATIONS

Hannis, et al "Nanoelectrospray mass spectrometry using non-metalized, tapered (50->10 micrometer) fused-silica capillaries" Rapid Comm. Mass Spectrom. 12, 443-448 (1998).*

(Continued)

*Primary Examiner*—Jack I Berman
*Assistant Examiner*—Michael Maskell
(74) *Attorney, Agent, or Firm*—Allan C. Tuan

(57) ABSTRACT

Electrospray ionization emitter arrays, as well as methods for forming electrosprays, are described. The arrays are characterized by a radial configuration of three or more nano-electrospray ionization emitters without an extractor electrode. The methods are characterized by distributing fluid flow of the liquid sample among three or more nano-electrospray ionization emitters, forming an electrospray at outlets of the emitters without utilizing an extractor electrode, and directing the electrosprays into an entrance to a mass spectrometry device. Each of the nano-electrospray ionization emitters can have a discrete channel for fluid flow. The nano-electrospray ionization emitters are circularly arranged such that each is shielded substantially equally from an electrospray-inducing electric field.

22 Claims, 2 Drawing Sheets

OTHER PUBLICATIONS

Wilm, et al "Electrospray and Taylor-cone theory, Dole's beam of macromolecules at last?" Int. J. Mass Spectrom. Ion Process 136, 167-180 (1994).*

Regele, J.D., et al., Aerosol Science, 33, (2002), pp. 1471-1479.

Duby, Marie-Helene, et al., Aerosol Science, 37, (2006), pp. 306-322.

Deng, W., et al., Aerosol Science, 37, (2006), pp. 696-714.

Deng, W, et al., Aerosol Science, 38, (2007) pp. 1062-1078.

International Search Report/Written Opinion.

Koerner, Terry, et al., "Porous Polymer Monolith Assisted Electrospray", Analytical Chemistry, Nov. 1, 2004, vol. 76, No. 21, 6456-6460 pps., Kingston, Ontario, Canada.

* cited by examiner

RADIAL ARRAYS OF NANO-ELECTROSPRAY IONIZATION EMITTERS AND METHODS OF FORMING ELECTROSPRAYS

STATEMENT REGARDING FEDERALLY SPONSORED RESEARCH OR DEVELOPMENT

This invention was made with Government support under Contract DE-AC0576RL01830 awarded by the U.S. Department of Energy. The Government has certain rights in the invention.

BACKGROUND

In the field of mass spectrometry (MS), over the past two decades, the use of electrospray ionization (ESI) has grown rapidly, particularly for biological applications. Its use has been accompanied by efforts to increase the ESI-MS sensitivity since only a small fraction of the analyte ions ever reach a mass spectrometer detector. Most ion losses can be attributed to incomplete droplet desolvation and/or poor transport from the atmospheric pressure region to the high vacuum region of a mass analyzer.

Two of the important factors affecting ionization efficiency, thus ESI-MS sensitivity, are the solution flow rate and the mode of electrospray operation. By reducing the solution flow rate, smaller droplets that are more readily desolvated can be formed. Accordingly, it can be advantageous to deliver the electrospray ionization solution to an ESI emitter at the lowest practical flow rate. Operation of the electrospray in the stable "cone-jet" mode, as opposed to other electrospray operation modes (e.g., pulsating, dripping, astable, etc.), can help to ensure that droplets are uniformly small, rather than a mixture of large and small droplets.

ESI emitter arrays, which include a plurality of individual emitters, can have the potential to provide a relatively high total solution flow rate while maintaining the lowest practical flow rate in each emitter. However, electrical shielding effects, which are not necessarily uniform among emitters in the array, can disrupt the cone-jet mode of operation in certain ones, though not necessarily all, of the emitters. The shielding can be caused by electrostatic interference between neighboring emitters. Therefore, in one example, the emitters in the outer portions of the array can experience a higher electrical field than those closer to the center. For a given applied voltage, the outermost emitters might experience corona discharge, the innermost emitters might operate in pulsating mode, and only a portion might operate in cone-jet mode. Furthermore, regardless of specific spray modes, ESI-MS sensitivity is significantly influenced by the electric field, and a particular field can exist that will provide maximum sensitivity. For example, there are many combinations of emitter geometries, flow rates, and solvents for which cone-jet mode operation is impossible. However, a maximum sensitivity will still be observed at a particular electric field, and will get worse as the field is either increased or decreased. So, even when cone-jet mode is not attained, a non-uniform field further contributes to decreased performance. Accordingly, a need exists for improved ESI emitter arrays, and particularly those operating at very low flow rates.

SUMMARY

One aspect of the present invention encompasses an apparatus having an array of electrospray ionization emitters that is interfaced to an entrance of a mass spectrometry device.

The array is characterized by a radial configuration of three or more nano-electrospray ionization emitters without an extractor electrode. Each nano-electrospray ionization emitter can comprise a discrete channel for fluid flow. The nano-electrospray ionization emitters are circularly arranged such that each is shielded substantially equally from an electrospray-inducing electric field.

Another aspect of the present invention encompasses a method for forming an electrospray of a liquid sample for analysis by mass spectrometry. The method is characterized by distributing fluid flow of the liquid sample among three or more nano-electrospray ionization emitters, forming an electrospray at outlets of the emitters without utilizing an extractor electrode, and directing the electrosprays into an entrance to a mass spectrometry device. Each of the nano-electrospray ionization emitters can comprise a discrete channel for fluid flow. The nano-electrospray ionization emitters are circularly arranged such that each is shielded substantially equally from an electrospray-inducing electric field.

As used herein, a radial configuration refers to a geometry wherein the nano-electrospray ionization emitters are arranged at an equal radial distance from an origin such that the tips of the nano-electrospray ionization emitters occur along the circumference of an imaginary circle having a radius equivalent to the radial distance. A nano-electrospray ionization emitter, as used herein, can refer to electrospray ionization emitter operating in a particularly low solution flow rate regime. Specifically, in some embodiments, the flow rate is less than approximately 1 μL/min for each emitter or 10 μL/min for the total flow rate of an array. Preferably, the flow rate is less than, or equal to, 100 nL/min for each emitter in the emitter array. As mentioned elsewhere herein, operating at low flow rates can be conducive to forming electrosprays in the stable cone-jet mode. An extractor electrode, as used herein, refers to a counter electrode having apertures that allow electrospray ionization jets/plumes to pass through. Typically, implementations of extractor electrodes require that each aperture be aligned with an individual electrospray ionization emitter with extremely high precision.

In preferred embodiments, the nano-electrospray ionization emitters are in substantially parallel alignment. More specifically, the portions of the emitters near the outlets should be substantially parallel such that the output/electrosprays from the emitters are formed in substantially the same direction.

In some embodiments, each discrete channel comprises a fused silica capillary. The outlets of the fused silica capillaries can be formed into tapered tips, which can encourage operation in the cone-jet mode. Alternatively, the discrete channels can comprise fabricated channels and a solid substrate. In such embodiments, traditional microfabrication techniques can be utilized to form the channels. In other embodiments, the inner diameter of the discrete channel is substantially constant through its axial length. In particular, the inner diameter should remain constant in the regions at, and leading up to, the outlets/tip of the nano-electrospray ionization emitters. Furthermore, the discrete channels can be filled with a porous monolithic material. One end of the emitter can be tapered and can have a tip comprising a protrusion of the porous monolithic material.

In some embodiments, the fluid flow in each discrete channel is limited to 100 nl/min. Total fluid flow can, therefore, scale up or down by increasing or decreasing, respectively, the number of nano-electrospray ionization emitters.

In still other embodiments, the mass spectrometry device, to which the nano-electrospray ionization emitter array is interfaced, can comprise a multi-capillary inlet.

The purpose of the foregoing abstract is to enable the United States Patent and Trademark Office and the public generally, especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Various advantages and novel features of the present invention are described herein and will become further readily apparent to those skilled in this art from the following detailed description. In the preceding and following descriptions at least the preferred embodiment of the invention is shown and/or described including, by way of illustration, the best mode contemplated for carrying out the invention. As will be realized, the invention is capable of modification in various respects without departing from the invention. Accordingly, the drawings and description of the preferred embodiment set forth hereafter are to be regarded as illustrative in nature, and not as restrictive.

DESCRIPTION OF DRAWINGS

Embodiments of the invention are described below with reference to the following accompanying drawings.

DETAILED DESCRIPTION

The following description includes the preferred best mode of one embodiment of the present invention. It will be clear from this description of the invention that the invention is not limited to these illustrated embodiments but that the invention also includes a variety of modifications and embodiments thereto. Therefore the present description should be seen as illustrative and not limiting. While the invention is susceptible of various modifications and alternative constructions, it should be understood that there is no intention to limit the invention to the specific form disclosed, but, on the contrary, the invention is to cover all modifications, alternative constructions, and equivalents falling within the spirit and scope of the invention as defined in the claims.

Figure 1:
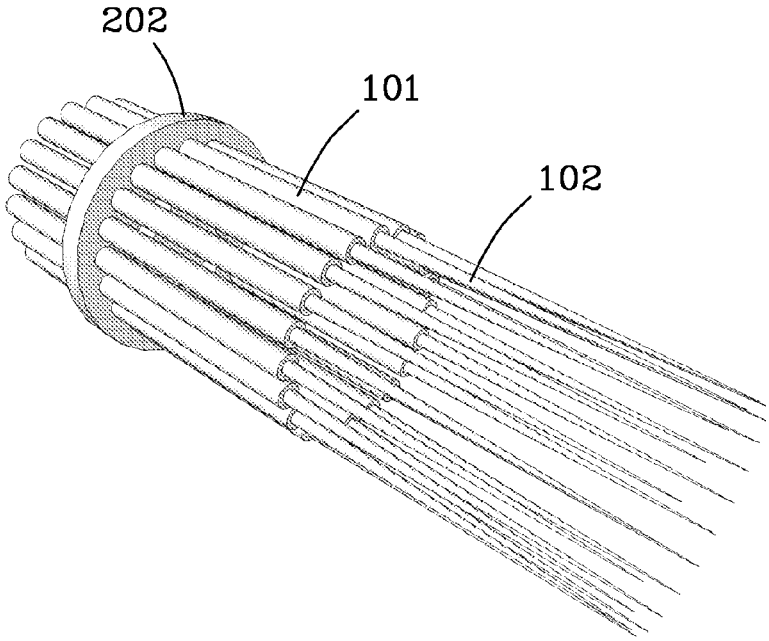
FIG. 1 is an illustration of the tip region of one embodiment of a radial array of nano-electrospray ionization emitters.

Referring to FIG. 1, a first view of one embodiment of the present invention is shown. A plurality of nano-electrospray ionization emitters are arranged in an array having a circular geometry. Each nano-electrospray ionization emitter 101 comprises a fused silica capillary having a tapered tip 102. While the tapered tips can be formed by traditional pulling techniques, in preferred embodiments the tapered tips are formed by chemical etching. Arranged in the radial configuration, each emitter in the array experiences the same electric field, and shielding among neighboring emitters is essentially uniform. Accordingly, all of the emitters can operate optimally with a given applied voltage and there is no need for an extractor electrode.

Figure 2:
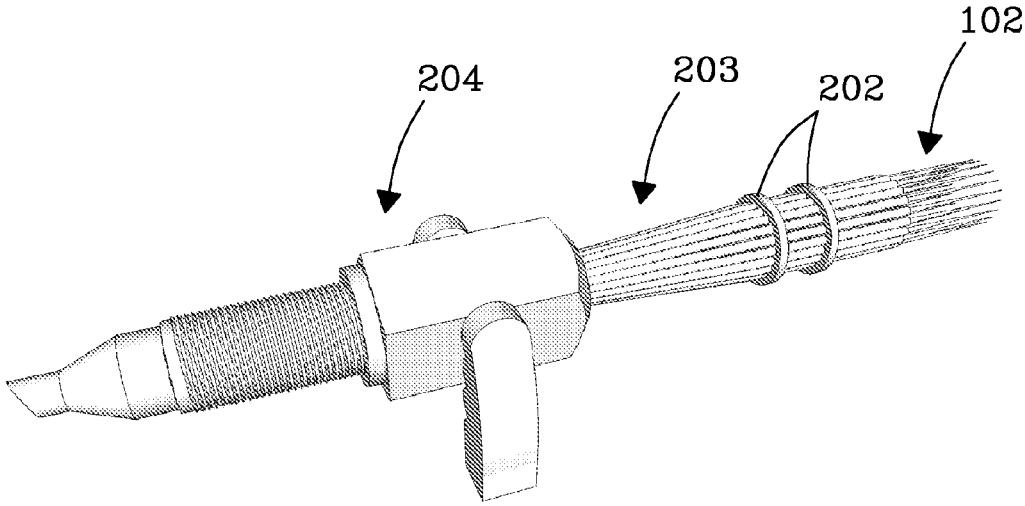
FIG. 2 is an illustration of a radial array of nano-electrospray ionization emitters according to one embodiment of the present invention.

The radial arrays of the instant embodiment can be fabricated, as illustrated in FIG. 2, by passing approximately 6 cm lengths of fused silica capillaries through holes in two discs 202, wherein the holes are placed at the desired radial distance and inter-emitter spacing. The two discs 202 can be separated to cause the capillaries to run parallel to one another at the tips of the nano-electrospray ionization emitters and the portions leading thereto. Alternatively, a single, thick disc, or any equivalent device for parallelizing the emitters, can be used. Relative to the tips 102, the distal ends 203 of the capillary tubes can be bundled together and inserted into a single, oversized tubing sleeve 204. The tips 102 can be tapered by sealing the distal ends 203 of the individual capillaries to allow water to be flowed through each capillary while the protective, outer polyimide coating is chemically removed and the capillary ends are etched in HF acid.

Figure 3:
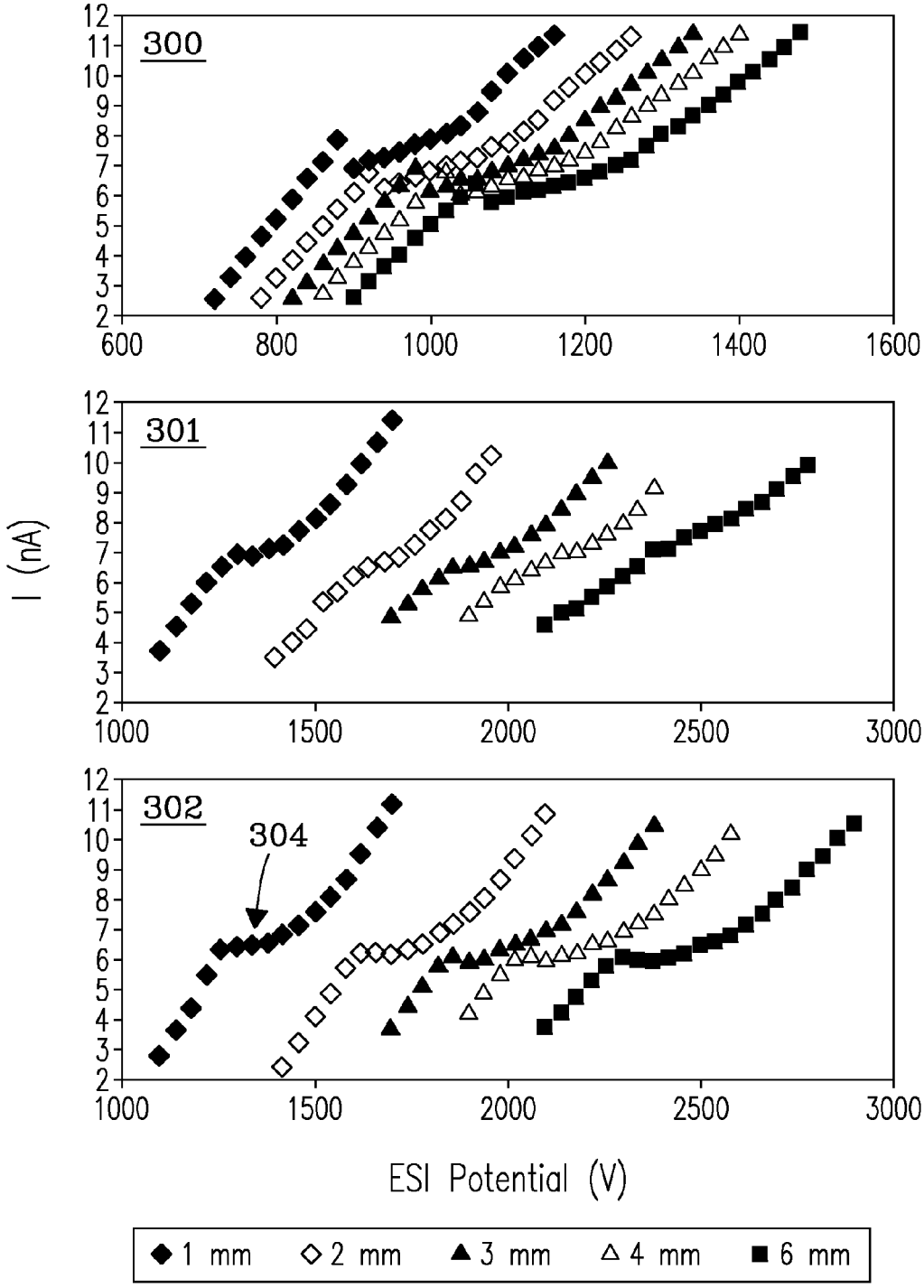
FIG. 3 contains plots of current versus voltage data during operation at various emitter-counterelectrode distances of an individual emitter, a linear array of emitters, and a radial array of emitters (top to bottom, respectively).

Referring to FIG. 3, graphs of current as a function of voltage 300-302 during operation of various electrospray ionization emitters are shown. The graphs present current versus voltage (I-V) curves at different emitter-counterelectrode distances for a single emitter 300, a linear array of emitters 301, and a radial array of emitters 302 according to embodiments of the present invention. Each of the emitters comprised fused silica capillaries. The linear array comprised a plurality of emitters arranged side-by-side in a single row. The spacing between emitters in both the linear and radial arrays was 500 μm. The flow rate for the arrays and for the single emitter was 50 nL/min/emitter. The current shown is the average current per emitter.

Characteristic I-V data for emitters presents a flattened portion 304 of the I-V curve when the electrospray operates in cone-jet mode (i.e., the current-regulated regime). In the case of the single emitter, the graph 300 shows that the I-V curves flatten somewhat at each distance, indicating that the electrosprays are operating in cone-jet mode. However, the graph 301 for the linear array shows that the characteristic current-regulated regime is only present at the smallest emitter-counterelectrode distances, and disappears completely as the distance is increased. With the radial array, according to graph 302, the cone-jet mode of operation is readily apparent over the entire range of observed emitter-counterelectrode distances. The poor performance of the linear array can be attributed to shielding effects, which cause each emitter to experience a different electric field. Accordingly, only a portion of the emitters experienced an appropriate electric field to induce operation in the cone-jet mode. The non-uniformities in the electric field experienced by each emitter are minimized in the radial array because of the uniform shielding among the emitters. Shielding effects are not relevant in the single emitter case, and the current-regulated regime is observed in the graph 300 at all of the emitter-counterelectrode distances.

While a number of embodiments of the present invention have been shown and described, it will be apparent to those skilled in the art that many changes and modifications may be made without departing from the invention in its broader aspects. The appended claims, therefore, are intended to cover all such changes and modifications as they fall within the true spirit and scope of the invention.

We claim:

1. An apparatus comprising an array of electrospray ionization emitters interfaced to an entrance of a mass spectrometry device, the array characterized by:

three or more nano-electrospray ionization emitters arranged in a radial configuration without an extractor electrode, each nano-electrospray ionization emitter comprises a discrete channel for fluid flow;

a total fluid flow directed to the entrance of the mass spectrometry device, the total fluid flow comprising electrosprays contributed from all of the three or more nano-electrospray ionization emitters; and a uniform electrospray-inducing electric field at the nano-electrospray ionization emitters, which are circularly positioned.

2. The apparatus of claim 1, wherein the nano-electrospray ionization emitters are in substantially parallel alignment.

3. The apparatus of claim 1, wherein each discrete channel comprises a fused silica capillary.

4. The apparatus of claim 3, wherein outlets of the fused silica capillaries are formed into tapered tips.

5. The apparatus of claim 1, wherein the discrete channels comprise fabricated channels in a solid substrate.

6. The apparatus of claim 1, wherein the inner diameter of the discrete channel is substantially constant through its axial length.

7. The apparatus of claim 6, wherein the discrete channels are filled with a porous monolithic material, wherein one end of the emitter is tapered to form a tip having a protrusion of the porous monolithic material.

8. The apparatus of claim 7, wherein the porous monolithic material comprises silica or a polymer.

9. The apparatus of claim 1, wherein the fluid flow in each discrete channel is less than 100 nL per minute.

10. The apparatus of claim 1, wherein the entrance to the mass spectrometer comprises a multi-capillary inlet.

11. A method for forming an electrospray of a liquid sample for analysis by mass spectrometry, the method for forming characterized by:

distributing fluid flow of the liquid sample among three or more nano-electrospray ionization emitters arranged in a radial configuration, each nano-electrospray ionization emitter comprises a discrete channel for fluid flow and is circularly positioned;

establishing a uniform electrospray-inducing electric field at the nano-electrospray ionization emitters;

forming electrosprays at outlets of all the emitters in the uniform electrospray-inducing electric field without using an extractor electrode; and directing a total fluid flow comprising the electrosprays from all of the three or more nano-electrospray ionization emitters to an entrance of a mass spectrometry device.

12. The method of claim 11, wherein the nano-electrospray ionization emitters are in substantially parallel alignment.

13. The method of claim 11, wherein each discrete channel comprises a fused silica capillary.

14. The method of claim 13, wherein outlets of the fused silica capillaries are formed into tapered tips.

15. The method of claim 11, wherein the discrete channels comprise fabricated channels in a solid substrate.

16. The method of claim 11, wherein the inner diameter of the discrete channel is substantially constant through its axial length.

17. The method of claim 16, wherein the discrete channels are filled with a porous monolithic material, wherein one end of the emitter is tapered, the one end having a tip comprising a protrusion of the porous monolithic material.

18. The method of claim 17, wherein the porous monolithic material comprises silica or a polymer.

19. The method of claim 11, wherein the fluid flow in each nano-electrospray ionization emitter is less than 100 nL per minute.

20. The method of claim 11, wherein the entrance to the mass spectrometer comprises a multi-capillary inlet.

21. The apparatus of claim 1, further comprising a given applied voltage at the array and uniform electrosprays among each of the three or more nano-electrospray ionization emitters.

22. The method of claim 11, wherein said forming electrosprays further comprises applying a given voltage to the array and forming uniform electrosprays among each of the three or more nano-electrospray ionization emitters.

* * * * *

UNITED STATES PATENT AND TRADEMARK OFFICE

CERTIFICATE OF CORRECTION

PATENT NO. : 7,816,645 B2
APPLICATION NO. : 12/046207
DATED : October 19, 2010
INVENTOR(S) : Ryan T. Kelly, Keqi Tang and Richard D. Smith It is certified that error appears in the above-identified patent and that said Letters Patent is hereby corrected as shown below:

IN THE SPECIFICATIONS:

Column 1, Lines 9-12 should be corrected as follows:

The invention was made with Government support under grant number RR018522 from the U.S. National Institutes of Health and contract DE-AC05-76RL01830 awarded by the US Department of Energy. The government has certain rights in the invention.

Signed and Sealed this
Twenty-first Day of August, 2012

David J. Kappos

David J. Kappos
*Director of the United States Patent and Trademark Office*